US006437297B2

(12) United States Patent
Weiss et al.

(10) Patent No.: US 6,437,297 B2
(45) Date of Patent: Aug. 20, 2002

(54) KITCHEN APPLIANCE WITH A COOKTOP RECEPTACLE PROVIDED IN A WORK SURFACE

(75) Inventors: Evelin Weiss, Mainz; Horst Stedron, Herborn; Michael Muskalla, Mainz; Bernd Schultheis, Schwabenheim, all of (DE)

(73) Assignee: Schott Glas, Mainz (DE)

( * ) Notice: Subject to any disclaimer, the term of this patent is extended or adjusted under 35 U.S.C. 154(b) by 0 days.

(21) Appl. No.: 09/760,873

(22) Filed: Jan. 16, 2001

(30) Foreign Application Priority Data

Jan. 15, 2000 (DE) ..... 100 01 451

(51) Int. Cl.[7] ..... H05B 3/68
(52) U.S. Cl. ..... 219/452.12
(58) Field of Search ..... 219/452.11, 452.12, 219/460.1, 461.1; 126/37 R, 37 A, 393, 90 A, 92 A, 211, 217; D23/292

(56) References Cited

U.S. PATENT DOCUMENTS 544,105 A * 8/1895 Madsen ..... 4/287
2,222,960 A * 11/1940 Strachan ..... 126/37 A
D154,577 S * 7/1949 Asaro ..... D23/272
3,289,664 A * 12/1966 Hewitt ..... 126/37 R
3,866,018 A * 2/1975 Hurko ..... 219/452.12
D235,644 S * 7/1975 Rastegar ..... D23/272
3,927,658 A * 12/1975 Olthuis ..... 219/452.12
4,304,382 A * 12/1981 Jelen ..... 248/220.42
4,363,956 A * 12/1982 Scheidler et al. ..... 219/452.12
5,399,839 A * 3/1995 Taplan et al. ..... 219/452.12

FOREIGN PATENT DOCUMENTS

DE 296 23 056.1 10/1997

* cited by examiner

*Primary Examiner*—Sang Paik
(74) *Attorney, Agent, or Firm*—Pauley Petersen Kinne & Erickson

(57) ABSTRACT

A kitchen appliance with a work surface made of a temperature-resistant plastic material or composite plastic material, which has a cooktop receptacle. To reduce the installation effort for use in a row of kitchen appliances, a kitchen sink has cutouts for associated plumbing fixtures and a control panel receptacle is embodied in the work surface, besides the cooktop receptacle. Splash guard edges with support receptacles for support elements for kitchen utensils, kitchen utensil deposits and/or kitchen utensil supports are formed on the work surface.

20 Claims, 3 Drawing Sheets

KITCHEN APPLIANCE WITH A COOKTOP RECEPTACLE PROVIDED IN A WORK SURFACE

BACKGROUND OF THE INVENTION

1. Field of the Invention

This invention relates to a kitchen appliance with a work surface made of a temperature-resistant plastic material or composite plastic material, which has a cooktop receptacle. The cooktop can be set into the cooktop receptacle in an interlocking and/or joint-fitting manner.

2. Description of Related Art

Such a kitchen appliance is known from German Patent Reference DE 296 23 056 U1, which only represents a portion of a cover of the devices and machines arranged in a row of kitchen appliances.

It is also known to provide a cover plate for a row of kitchen appliances, which covers several kitchen utensils and kitchen cabinets arranged next to each other and in which various kitchen equipment is installed. The lined-up kitchen utensils and kitchen cabinets can be covered by partial cover plates. These partial cover plates can be connected with each other.

SUMMARY OF THE INVENTION

It is one object of this invention to provide a kitchen appliance of the type mentioned above but which keeps the installation cost as low as possible, when used in a row of kitchen appliances, and so that cleaning is easier.

This object of this invention is achieved with a kitchen sink having cutouts for associated plumbing fixtures and a control panel receptacle which is embodied in the work surface, besides the cooktop receptacle. Splash guard edges with support receptacles for support elements for kitchen utensils, kitchen utensil deposits and/or kitchen utensil supports are formed on the work surface.

This work surface is particularly suited for single kitchens with kitchen sinks and an electric stove, because these, together with the kitchen sink, the splash guard edges with support receptacles and the cooktop receptacle, form a one-piece, easy-to-clean unit. In this case the support receptacles of the splash guard edges can receive support elements to which kitchen utensils are attached, or are attached on parts of kitchen utensil deposits and kitchen utensil supports, preferably formed thereon.

In accordance with one embodiment, the kitchen sink is molded from the work surface, and the cutouts for the plumbing fixtures, as well as the support receptacles, are formed on the work surface and the splash guard edges, to keep the installation effort for the kitchen appliance particularly low.

In accordance with one embodiment, the attachment of kitchen utensils to the kitchen appliance of this invention becomes particularly simple because the support elements of the kitchen utensils, the kitchen utensil supports and the kitchen utensil deposits are designed as suspension elements with locking springs, in which the support receptacles formed as suspension slits can be suspended and locked.

In a further embodiment, the control panel can be set into an inclined border raised above the surface of the work surface with an inclination toward the operating side as a receptacle for the control panel, the control panel can be set into the control panel receiver so that it can be particularly well observed from the operating side of the kitchen appliance.

The space requirements for the kitchen appliance of this invention with the associated kitchen utensils and/or kitchen cabinets can be kept low because the work surface has splash guard edges on two sides, which extend perpendicularly with respect to each other. The kitchen sink is arranged in the area of one side of the work surface and the cooktop receptacle in the area of the other side. The work surface of the corner of the two opposite sides between the kitchen sink and the cooktop receptacle is concavely rounded.

In accordance with one embodiment, the cooktop can be inserted into the cooktop receptacle because the cooktop receptacle has an offset support edge, on which the cooktop is supported and glued together. Thus, the cooktop is glued to the support strip by temperature-resistant adhesives, such as silicon.

If screw receptacles for fastening a covered well with support elements for the heating elements are formed on the underside of the work surface around the cooktop receptacle, then the covered well with the heating elements can be easily inserted into the kitchen appliance. The heating elements are at the same time covered and can be in radiant contact only with the cooktop.

In accordance with another embodiment, the cooktop receptacle is formed in the work surface as a one-piece covered well. The cooktop, which is surrounded by a surrounding frame, can be locked into locking receivers of the work surface by locking shoulders of the frame. The heating elements are inserted into the covered well, which is formed in one piece in the work surface, before the cooktop is inserted into the cooktop receptacle and covers the heating elements. Fixing the heating elements in place in the covered well is easier because the covered well formed in the work surface has screw receptacles formed thereon for support elements of the heating elements.

In order to minimize the material cost for the kitchen appliance, but yet provide sufficient stability, reinforcement strips are formed on the underside of the work surface.

BRIEF DESCRIPTION OF THE DRAWINGS

This invention is explained in greater detail in view of embodiments represented in the drawings, wherein.

DESCRIPTION OF PREFERRED EMBODIMENTS

Figure 1:
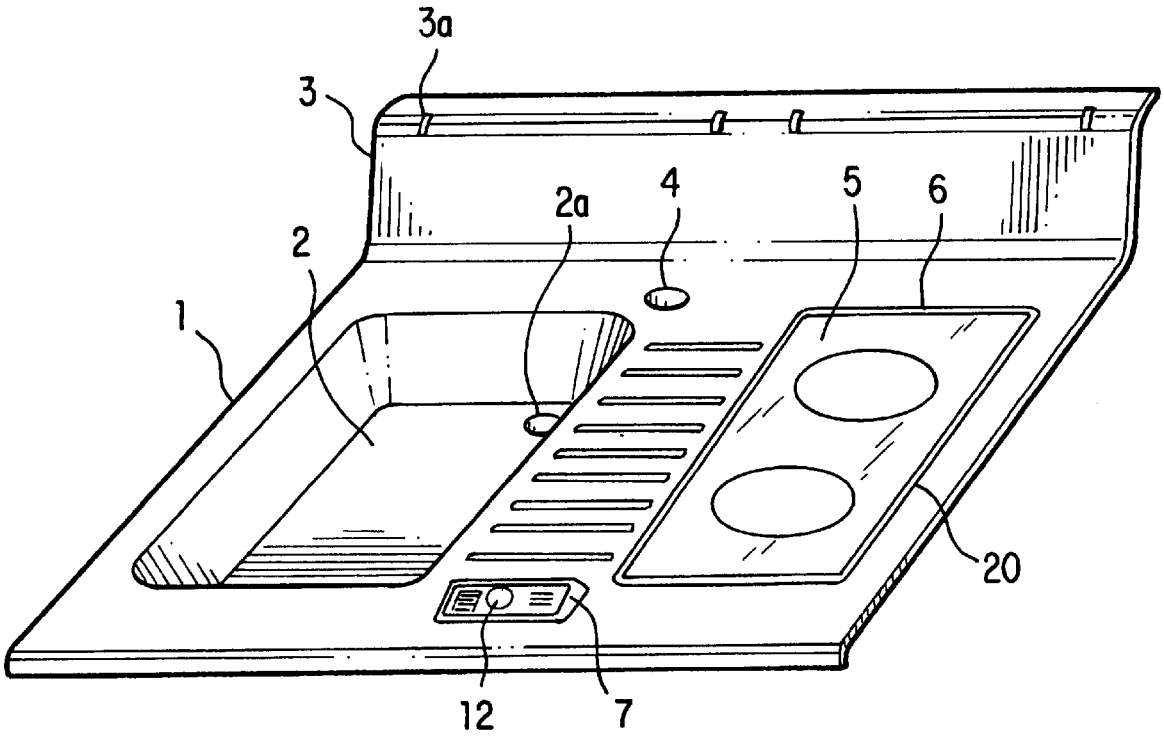
FIG. 1 is a perspective top view of a rectangular shaped kitchen appliance with a kitchen sink, splash guard edges, cooktop receptacle and support receptacles in the splash guard edges.

As shown in the perspective top view in FIG. 1, a kitchen sink 2 is molded in a rectangular-shaped work surface 1 made of temperature-resistant plastic or a composite plastic material, and a cutout 2*a* for a drain set is formed in the kitchen sink 2. The back of the work surface 1 is pulled up to form a splash guard edge 3. Support receptacles 3*a*, which can be designed as suspension slits, are formed in the splash guard edge 3. A formed-out or molded cooktop receptacle 20 is set into the work surface 1, into which a cooktop 5 with a surrounding frame 6 can be inserted. A control panel receptacle 7 for a control panel 12 is molded or formed-out from the remaining surface in the area between the kitchen sink 2 and the cooktop receptacle 20, wherein the control panel receptacle 7 in the form of an enclosure inclined toward the operating side assures that the control panel 12 can be easily seen and read from the operating side. An additional cutout 4 for plumbing fixtures is formed in the area around the molded kitchen sink 2.

Figure 2:
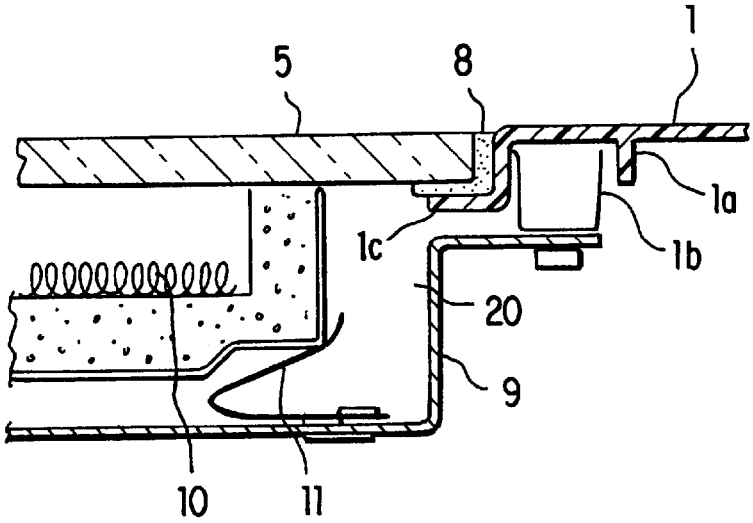
FIG. 2 is a partial cross section of a first embodiment of the cooktop receptacle with the cooktop installed.

As FIG. 2 shows, the cooktop receptacle 20 is surrounded by an offset support strip 1*c*, on which the inserted cooktop 5 is supported and with which is glued together. A temperature-resistant adhesive 8, for example silicon, can be used for this purpose. Screw receptacles 1*b* are formed on the underside of the work surface 1 around the cooktop receptacle 20, so that a covered well 9 can complete the cooktop receptacle 20 and receive the heating elements 10 for the cooktop 5. The heating elements 10 can be fastened in the covered well 9 by means of support elements 11. The work surface 1 can be reinforced by means of reinforcement bars 1*a* on the underside in order to achieve sufficient sturdiness, along with a small material cost.

Figure 3:
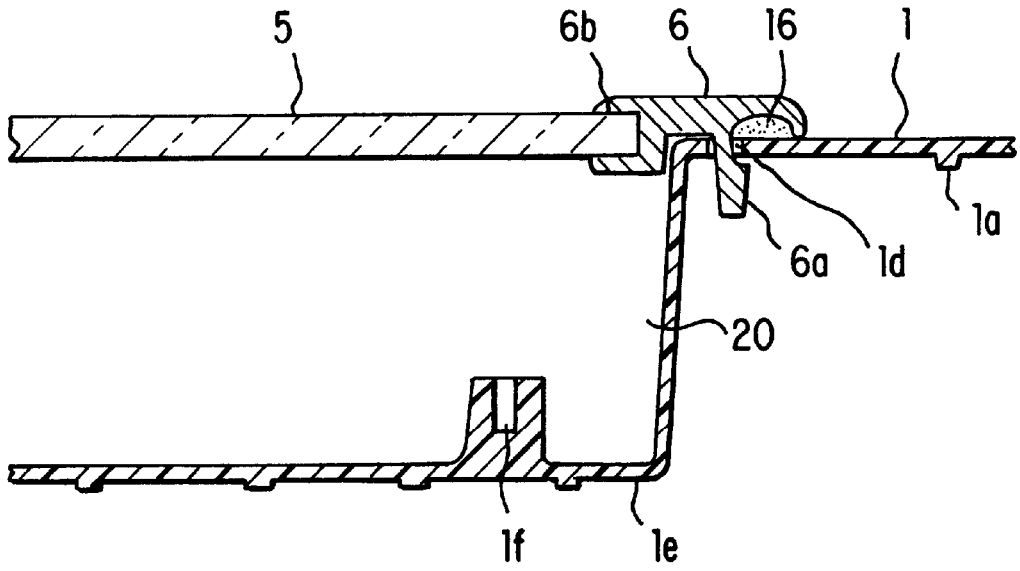
FIG. 3 is a partial cross section of a second embodiment of the cooktop receptacle with a covered well formed in one piece in the cooktop receptacle.

In the embodiment in accordance with FIG. 3, the covered well 1*e* is formed as one piece from the work surface 1. Screw receptacles 1*f* are formed for fastening the heating elements. The cooktop 5 is maintained in a surrounding frame 6, as the receiving groove 6*b* shows. Locking receivers 1*d* are formed around the cooktop receptacle 20, into which locking shoulders 6*a* of the surrounding frame 6 are inserted. A sealing element 16 is arranged between the surrounding frame 6 and the work surface 1.

Figure 4:
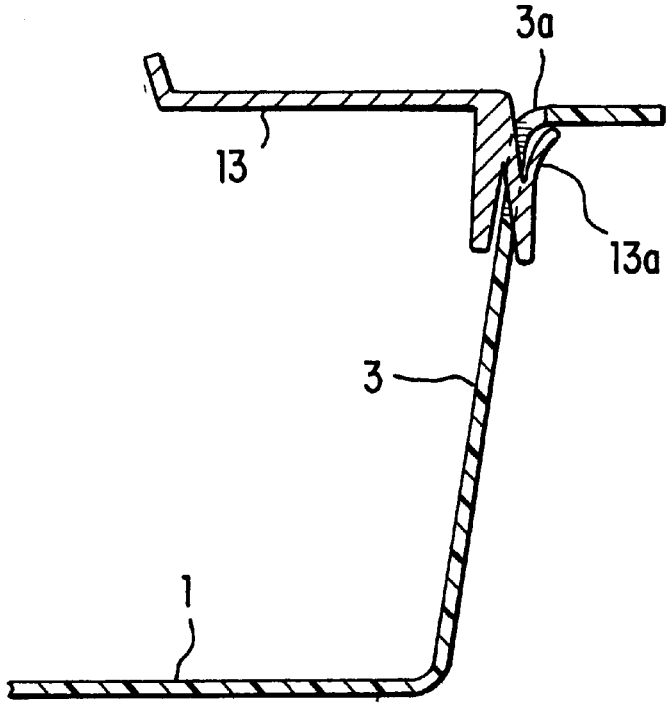
FIG. 4 is a partial cross section of a support receptacle with a splash guard edge and with a locked-in support element for a kitchen utensil deposit.

FIG. 4 shows in a partial cross section of a splash guard edge 3 the attachment of a kitchen utensil deposit 13, which has formed-on support elements 13*a*. The support elements 13*a* can be suspended and locked in the support receivers 3*a*, embodied as suspension slits, of the splash guard edge 3, as indicated by the locking springs of the support elements 13*a*.

Figure 5:
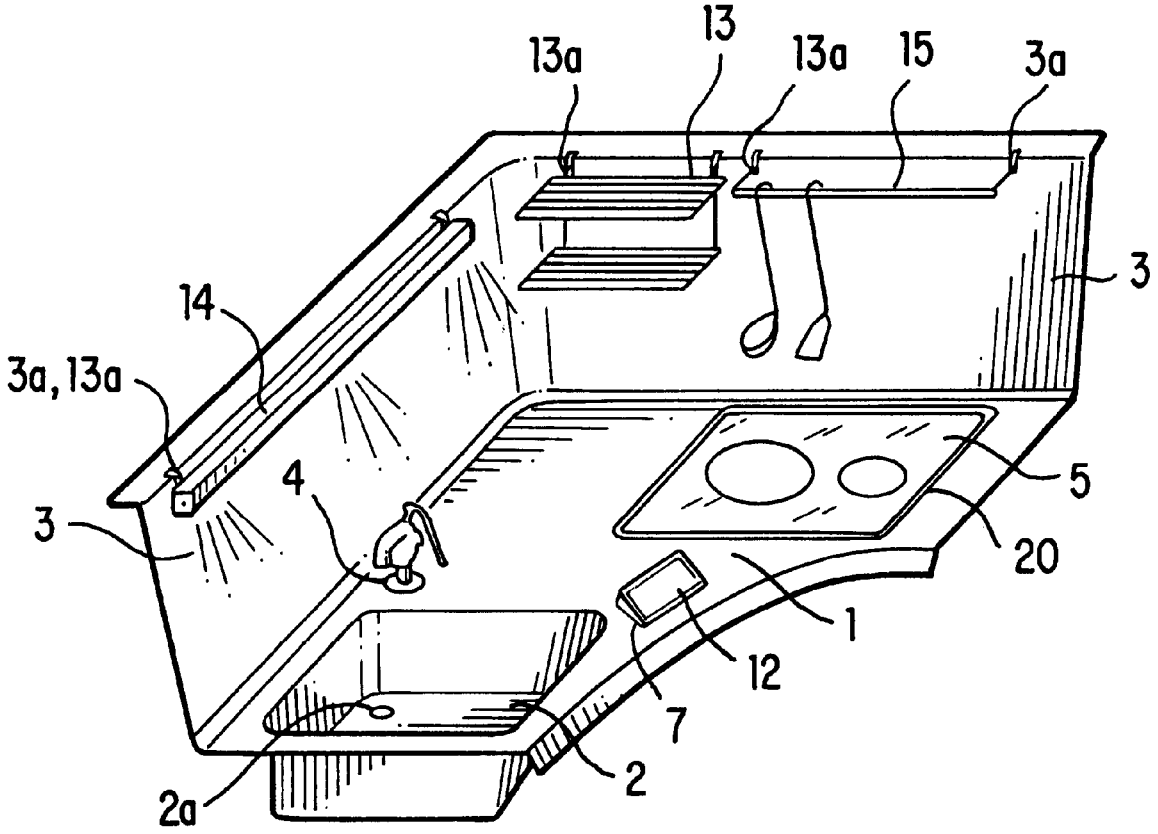
FIG. 5 is a perspective top view of a corner kitchen appliance with a kitchen sink, splash guard edges and a cooktop receptacle.

On two sides of the work surface 1 extending perpendicular to each other, the unit in accordance with FIG. 5, which is designed as a corner kitchen appliance, has splash guard edges 3 with support receivers 3*a* formed out of them, in which the kitchen utensil deposit 13 and the kitchen utensil support 15, having support elements 13*a*, can be suspended and locked. The kitchen sink 3 is arranged in the area of a splash guard edge 3, and the cooktop receptacle 20 with the cooktop 5 in the area of the other splash guard receptacle 3, wherein respectively one side of the kitchen sink 2, or of the cooktop receptacle 20, extends parallel with the facing splash guard edge 3. A kitchen utensil 14, for example in the form of a kitchen lamp, having support elements 13*a*, can also be fastened on the splash guard edge 3.

The side of the work surface 1 opposite the corner of the kitchen appliance is concavely rounded to simplify operation of the kitchen appliance from this side.

What is claimed is:

1. In a kitchen appliance with a work surface made of a temperature-resistant plastic material or a composite plastic material, having a cooktop receptacle, the improvement comprising:

a kitchen sink (2) with a plurality of cutouts, (2*a*, 4) for associated plumbing fixtures and a control panel receptacle (7) embodied in the work surface (1), in addition to the cooktop receptacle (20), and a plurality of splash guard edges (3) with a plurality of support receptacles (3*a*) each accepting a support element (13*a*) for supporting at least one of kitchen utensils (14), kitchen utensil deposits (13) and kitchen utensil supports (15).

2. In the kitchen appliance in accordance with claim 1, wherein the cooktop receptacle (20) is formed in the work surface (1) as a one-piece covered well (1*e*), and the cooktop (5) which is surrounded by a surrounding frame (6) is lockable into locking receivers (1*d*) of the work surface (1) by locking shoulders (6*a*) of the frame (6).

3. In the kitchen appliance in accordance with claim 13, wherein the covered well (1*e*) formed in the work surface (1) has screw receptacles (1*f*) formed for support elements (11) of the heating elements (10).

4. In the kitchen appliance in accordance with claim 3, wherein reinforcement strips (1*a*) are formed on the underside of the work surface (1).

5. In the kitchen appliance in accordance with claim 1, wherein the support elements (13*a*) of the at least one of the kitchen utensils (14), the kitchen utensil supports (15) and the kitchen utensil deposits (13) are suspension elements with locking springs in which the support receptacles (3*a*) formed as suspension slits are suspended and locked.

6. In the kitchen appliance in accordance with claim 1, wherein a control panel (12) is set into an inclined border raised above a surface of the work surface (1) with an angle toward an operating side as the control panel receptacle (7).

7. In the kitchen appliance in accordance with claim 1, wherein the work surface (1) has the splash guard edges (3) on two sides which extend perpendicularly with respect to each other, the kitchen sink (2) is arranged in a first area of one side of the work surface (1) and the cooktop receptacle (20) is arranged in a second area of an other side of the work surface (1), and the work surface (1) opposite a corner of the two sides between the kitchen sink (2) and the cooktop receptacle (20) is concavely rounded.

8. In the kitchen appliance in accordance with claim 1, wherein the cooktop receptacle (20) has an offset support edge (1*c*) on which the cooktop (5) is supported and is glued together (8).

9. In the kitchen appliance in accordance with claim 8, wherein the cooktop (5) is glued to the support edge (1*c*) with a temperature-resistant adhesive (8).

10. In the kitchen appliance in accordance with claim 1, wherein a plurality of screw receptacles (1*b*) for fastening a covered well (9) with support elements (11) for heating elements (10) are formed on an underside of the work surface (1) around the cooktop receptacle (20).

11. In the kitchen appliance in accordance with claim 10, wherein the covered well (1*e*) formed in the work surface (1) has screw receptacles (1*f*) formed for support elements (11) of the heating elements (10).

12. In the kitchen appliance in accordance with claim 1, wherein reinforcement strips (1*a*) are formed on an underside of the work surface (1).

13. In a kitchen appliance with a work surface made of a temperature-resistant plastic material or a composite plastic material, having a cooktop receptacle, the improvement comprising:

a kitchen sink (2) with a plurality of cutouts (2*a*, 4) for associated plumbing fixtures and a control panel receptacle (7) embodied in the work surface (1), in addition to the cooktop receptacle (20), and a plurality of splash guard edges (3) with support receptacles (3*a*) for support elements (13*a*) for supporting at least one of kitchen utensils (14), kitchen utensil deposits (13) and kitchen utensil supports (15) formed on the work surface, the cooktop receptacle (20) formed in the work surface (1) as a one-piece covered well (1*e*), and the cooktop (5) which is surrounded by a surrounding frame (6) being lockable into locking receivers (1*d*) of the work surface (1) by locking shoulders (6*a*) of the frame (6).

14. In the kitchen appliance in accordance with claim 13, wherein the kitchen sink (2) is molded from the work surface (1), and the cutouts (2*a*, 4) for the plumbing fixtures and the support receptacles (3*a*) are formed on the work surface (1) and the splash guard edges (3).

15. In the kitchen appliance in accordance with claim 14, wherein the support elements (13*a*) of the at least one of the kitchen utensils (14), the kitchen utensil supports (15) and the kitchen utensil deposits (13) are suspension elements with locking springs in which the support receptacles (3*a*) formed as suspension slits are suspended and locked.

16. In the kitchen appliance in accordance with claim 15, wherein a control panel (12) is set into an inclined border raised above a surface of the work surface (1) with an angle toward an operating side as the control panel receptacle (7).

17. In the kitchen appliance in accordance with claim 16, wherein the work surface (1) has the splash guard edges (3) on two sides which extend perpendicularly with respect to each other, the kitchen sink (2) is arranged in a first area of one side of the work surface (1) and the cooktop receptacle (20) is arranged in a second area of an other side of the work surface (1), and the work surface (1) opposite a corner of the two sides between the kitchen sink (2) and the cooktop receptacle (20) is concavely rounded.

18. In the kitchen appliance in accordance with claim 17, wherein the cooktop receptacle (20) has an offset support edge (1*c*) on which the cooktop (5) is supported and is glued together (8).

19. In the kitchen appliance in accordance with claim 18, wherein the cooktop (5) is glued to the support edge (1*c*) with a temperature-resistant adhesive (8).

20. In the kitchen appliance in accordance with claim 19, wherein a plurality of screw receptacles (1*b*) for fastening a covered well (90 with support elements (11) for heating elements (10) are formed on an underside of the work surface (1) around the cooktop receptacle (20).

* * * * *